US005089849A

United States Patent [19]

Hiraoka

[11] Patent Number: 5,089,849

[45] Date of Patent: Feb. 18, 1992

[54] IMAGE FORMING APPARATUS, AND METHOD OF POSITIONING THE UNITS INCORPORATED IN AN IMAGE FORMING APPARATUS

[75] Inventor: Satoshi Hiraoka, Hachiooji, Japan

[73] Assignee: Kabushiki Kaisha Toshiba, Kawasaki, Japan

[21] Appl. No.: 596,426

[22] Filed: Oct. 11, 1990

Related U.S. Application Data

[63] Continuation of Ser. No. 397,977, Aug. 24, 1989, abandoned.

[30] Foreign Application Priority Data

Sep. 30, 1988 [JP] Japan ..... 63-128361[U]

[51] Int. Cl.[5] ..... G03G 5/00

[52] U.S. Cl. ..... 355/211; 118/661; 355/245; 355/260

[58] Field of Search ..... 355/245, 251, 252, 261, 355/259, 260, 211; 118/645, 661, 651

[56] References Cited

U.S. PATENT DOCUMENTS

| | | | |
|---|---|---|---|
| 3,953,121 | 4/1976 | Reichart, Jr. | 355/245 |
| 4,258,372 | 3/1981 | Ishikawa | 355/245 X |
| 4,271,786 | 6/1981 | Buckley et al. | 118/661 |
| 4,426,148 | 1/1984 | Ikemoto et al. | 355/251 |
| 4,814,816 | 3/1989 | Idenawa | 355/259 |
| 4,827,305 | 5/1989 | Enoguchi et al. | 355/259 |

*Primary Examiner*—A. T. Grimley
*Assistant Examiner*—Sandra L. Brase
*Attorney, Agent, or Firm*—Oblon, Spivak, McClelland, Maier & Neustadt

[57] ABSTRACT

An image forming apparatus includes a photosensitive unit having a photosensitive body, another unit having a member opposing the photosensitive body of the photosensitive unit, and a support arrangement for supporting at least one of the units and allowing this at least one unit to move toward and away from the other unit. A bias arrangement applies a force to the at least one unit movably supported by the support arrangement to move this unit toward the other unit, and a positioning arrangement for positioning the photosensitive unit and the other unit is included such that a gap is provided between the photosensitive body and the member.

10 Claims, 8 Drawing Sheets

IMAGE FORMING APPARATUS, AND METHOD OF POSITIONING THE UNITS INCORPORATED IN AN IMAGE FORMING APPARATUS

This application is a continuation of application Ser. No. 07/397,977, filed on Aug. 24, 1989, now abandoned.

BACKGROUND OF THE INVENTION

1. The present invention relates to an electrophotographic image forming apparatus in which the distance between the photosensitive unit and any other unit associated with the photosensitive unit can be maintained at a constant value, and also to a method of positioning the photosensitive unit and other units of an image forming apparatus.

2. Description of the Related Art

An electrophotographic image forming apparatus comprises a photosensitive unit, a charging unit, a exposure unit, a developing unit, an image transfer unit, a fixing unit, a discharging unit, and a cleaner. The photosensitive unit has a photosensitive member or a photosensitive drum. Every time the photosensitive drum is rotated through 360°, the apparatus forms an image. More specifically, the charging unit electrically charges the photosensitive surface of the drum. Then, the optical image generated by the exposure unit is applied to the photosensitive surface, thus forming an electrostatic latent image thereon. Next, the developing unit applies toner onto the photosensitive surface of the drum, thereby developing the latent image into a toner image which is visible. In other words, the image is developed. Thereafter, the image transfer unit transfers the toner image from the drum to a sheet of recording paper. Then, the fixing unit fixes the toner image on the recording paper. After the transfer of the image, the discharging unit electrically discharges the photosensitive surface of the drum, and the cleaner removes the residua toner from the photosensitive surface of the drum.

The developing unit has a rotatable sleeve by which the toner particles carried by a toner cartridge are applied onto the photosensitive surface of the drum. To attract the toner, which has been applied from the developing sleeve, onto the photosensitive surface, it is required that a gap be provided between the developing sleeve and the photosensitive drum. This gap must be uniform all along the drum, so that the toner is uniformly distributed on the entire surface of the drum thereby to from a high-quality image. However, it is difficult to provide a gap which is uniform over the entire length of the drum, for the reason set forth below.

The photosensitive unit has a frame, in which the drum is rotatably supported. Similarly, the developing unit has a frame, in which the developing sleeve is rotatably supported. The frames of both units are attached to a support which in turn is fastened to the housing of the image forming apparatus. The frames are located such that the sleeve faces the drum contact. Annular protrusions are formed on the ends of the sleeve, thus defining a gap between the sleeve and the drum. Usually, the developing unit is positioned adjacent to the photosensitive unit by its own weight, so that the protrusions of the sleeve contact the photosensitive surface of the drum, with the gap maintained between the sleeve and drum.

In the above prior image forming apparatus, when the photosensitive drum is replaced with a new one, or cleaned, the developing unit is moved away from the photosensitive unit, to separate the developing sleeve therefrom. Thereafter, the new drum or cleaned drum is mounted on the apparatus. In this time, if the new drum or cleaned drum is mounted, mistakenly slantwise to the developing sleeve, the annular protrusions provided on both ends of the developing sleeve cannot properly come into contact with the photosensitive drum, so that the gap between the photosensitive drum and the developing sleeve is not uniform over the entire length of the drum. In this case, in order to obtain the uniform gap between the drum and the sleeve, the gap is adjusted. For the purpose of such gap adjustment, the photosensitive unit and the developing unit are mounted at the predetermined mounting positions of the housing by respective supports so that they can be slightly moved by respective adjusting members to finely adjust their mounting positions. In other words, the mounting positions of the photosensitive drum and the developing sleeve are finely adjusted by the adjusting members so that the gap between the photosensitive drum and the developing sleeve becomes constant over the entire length of the drum. However, it is difficult for a conventional operator to perform such fine adjustments as to make the protrusions of the sleeve uniformly contact the drum by slightly moving the drum and/or the sleeve so that the drum and the sleeve are in parallel with to each other. Accordingly, for example, when the operator replaces the photosensitive drum with a new one, and finely adjusts the photosensitive unit there is a possibility that and the developing unit, the operator will touch the photosensitive surface of the drum and damages it. For this reason, the replacement or cleaning of the drum must be performed by an expert service man.

The photosensitive drum and developing sleeve may be constructed with high accuracy so as to eliminate the need for fine adjustments. However, in this case, high accurate parts and high precision assembling are required for the drum and sleeve, resulting in an increased cost of the apparatus.

Even if the positions of the photosensitive unit and the developing unit are minutely adjusted before the image forming apparatus is delivered from the factory, these units are not always exactly parallel to each other, and the gap between them is not always uniform over the entire length of the drum. Further, even if such non-uniformity of the gap is tolerable, the gap between the, sleeve and the drum may become non-uniform to a greater degree due to the wear of the annular protrusions. When the gap between the sleeve and the drum is not uniform for whatever reason, it is no longer possible to distribute the toner evenly on the photosensitive surface of the drum, and a high-quality image can hardly be formed.

SUMMARY OF THE INVENTION

The first object of the present invention is to provide an electrophotographic image forming apparatus, in which the gap between the drum of a photosensitive unit and the sleeve of a developing unit, for example, remains uniform over the entire length of the drum, so that toner is supplied through the gap and distributed uniformly on the entire surface of the drum, thereby forming an image of high quality.

The second object of the invention is to provide an electrophotographic image forming apparatus in which the gap between the drum of a photosensitive unit and the sleeve of a developing unit remains uniform over the entire length of the drum, though either unit is simple in structure and comprises no high-precision parts.

The third object of this invention is to provide a method of positioning the photosensitive unit and another unit of an image forming apparatus, such that a gap uniform over the entire length of the photosensitive unit is defined between the photosensitive unit and the other unit.

According to the present invention, at least either the photosensitive unit or the other unit is urged to move toward the other and can be moved away from the other. The photosensitive unit and the other unit are located by positioning means, such that a gap is formed between the other unit and the drum of the photosensitive unit, which is uniform along the entire length of the drum.

DETAILED DESCRIPTION OF THE PREFERRED EMBODIMENTS

Embodiments of the present invention will now be described, with reference to the accompanying drawings.

Figure 1:
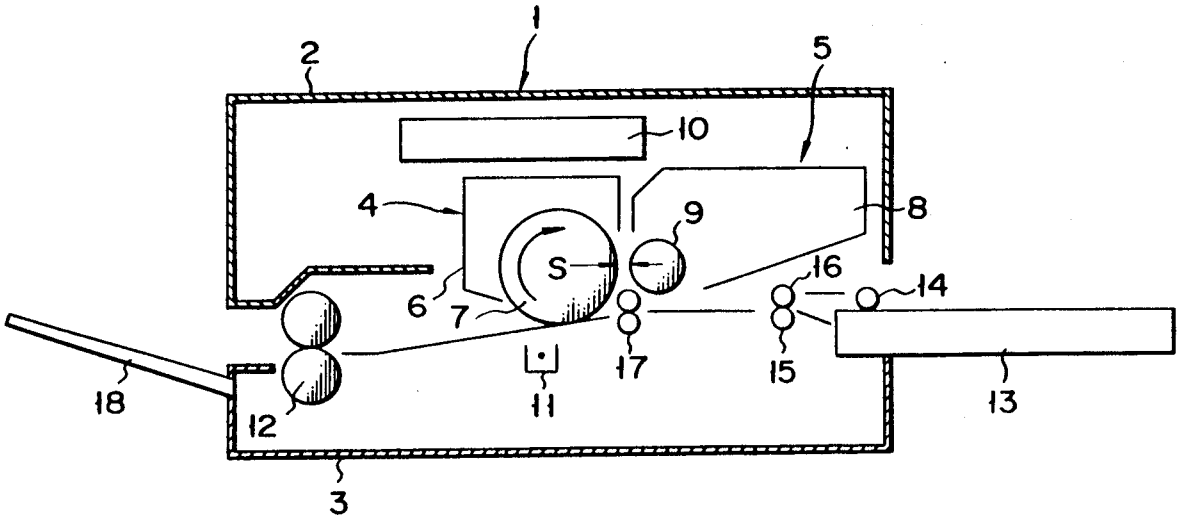
FIG. 1 is a sectional view schematically showing an image forming apparatus according to the present invention.
Figure 2:
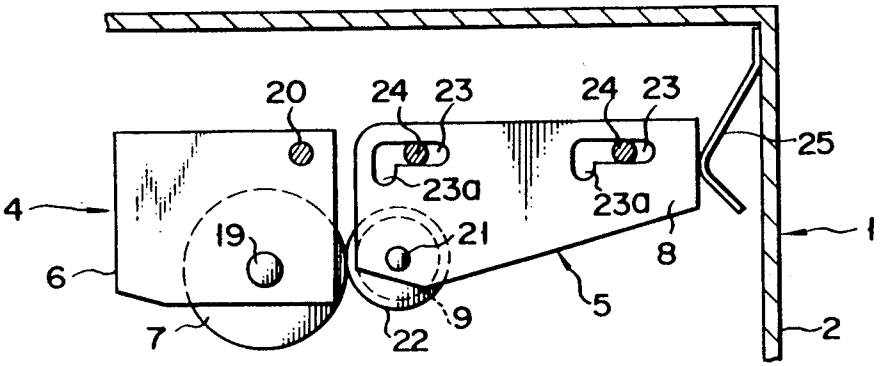
FIGS. 2 and 3 are a front view and a plan view, respectively, both illustrating the photosensitive unit and the developing unit which are incorporated in the image forming apparatus shown in FIG. 1.
Figure 3:
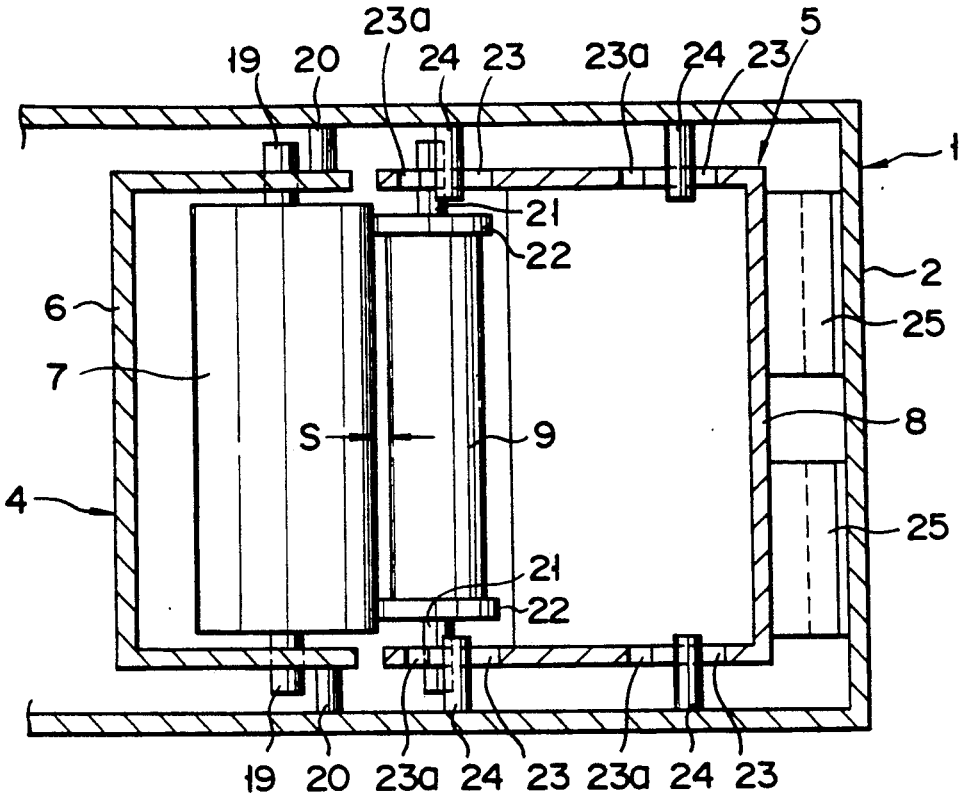

With reference to FIGS. 1 to 3, an image forming apparatus, in accordance with a first embodiment of the invention, will be described. As is illustrated in FIG. 1, the apparatus comprises a housing 1 which consists of an upper half 2 and a lower half 3, either shaped like an open box. These housing halves 2 and 3 are hinged together at one side, such that the upper half can be rotated upward.

The housing 1 contains a photosensitive unit 4 and a developing unit 5 located beside the unit 4. The photosensitive unit 4 comprises a frame 6 and a photosensitive drum 7 rotatably supported by the frame 7. The developing unit 5 comprises a frame 8 and a developing sleeve 9 attached to the frame 8. Both unit 4 and 5 will be described later in detail.

The housing 1 also contains an exposure unit 10 set above the photosensitive unit 4, an image transfer unit 11 located right below the unit 4, and image-fixing rollers 12 arranged downstream from the image transfer unit 11. A charging unit, a discharging unit, and a cleaning unit (not shown) are arranged around the photosensitive drum 7 in the rotating direction thereof. A paper cassette 13 is partly inserted in the housing 1. A paper-feeding roller 14 and a paper-feeding roller 15, separating roller 16, and a pair of resist rollers 17 are provided within the housing 1. A paper tray 18 is attached to the housing 1. The cassette 13, the rollers 14, 15, 16, 17, and the tray 18 constitute a paper passage.

The photosensitive unit 4 and the developing unit 5 will now be described in detail, with reference to FIGS. 2 and 3.

The photosensitive drum 7 of the unit 4 is made of metal such as aluminum. Its outer periphery, except for those portions which contact the annular protrusions (later described) of the sleeve 9, has been processed and rendered photosensitive. The drum 7 is mounted on a shaft 19 which extends horizontally and is rotatably supported by the frame 6. The frame 6 extends horizontally and is connected at both ends to the wall of the housing 1 by means of a support rod 20. Drum 7 is driven by a drive mechanism (not shown) which is incorporated within the housing 1.

The frame 8 of the developing unit 5 is shaped like a box. It supports a toner cartridge (not shown) on its top, and applies the toner from the cartridge to the photosensitive drum 7 of the photosensitive unit 4. The frame 8 has a slit in the bottom which opposes the photosensitive drum 7. The developing sleeve 9 is a roller made of wear-resistant metal such as aluminum, located in the slit of the frame 8, extending horizontally, and rotatably mounted on an axle 21. The sleeve 9 has two annular protrusions 22 formed at the ends, respectively. These protrusions 22 contact the photosensitive drum 7, thus defining a gap S between the drum 7 and the sleeve 9, through which the toner can be applied from the developing unit 5 to the photosensitive drum 7. The width of the ga S is determined by the heights of the annular protrusions 22.

Two elongated holes 23 are made in either walls of the frame 8. These holes 23 extend horizontally and have the same length for which the frame 8 can move horizontally to adjust the gap S between the drum 7 and the sleeve 9. Two pairs of pins 24 project from the opposing walls of the housing 1 into the holes 23, and extend horizontally at right angles to the direction in which the frame 8 can move. Hence, the pins 24 support the developing unit 5 such that this unit 5 can move toward and away from the photosensitive unit 4. Each hole 23 has a portion 23*a* extending downward. When the frame 8 is moved away from the unit 4, the pins 24 fall into the portions 23*a* of the holes 23, whereupon the frame 8 can no longer be moved away from the unit 4. The elongated holes 23 can be replaced by grooves cut in the opposing walls of the frame 8.

Two leaf springs 25 are attached to the inner surface of the end wall of the housing 1, spaced side by side from each other. These springs 25 apply a spring for which pushes frame 8 toward the photosensitive unit 4. Since the frame 8 is thus biased by the leaf springs 25, the annular protrusions 22 are held in contact with the outer periphery of the photosensitive drum 7, whereby the gap S is provided between the drum 7 and the sleeve 9. The leaf springs 25 can be replaced by compression coil springs. The developing sleeve 9 is rotated by a drive mechanism (not shown).

As has been described, the leaf springs 25 bias the frame 8 of the developing unit 5 toward the photosensitive drum 7, along the elongated holes 23, and force the annular protrusions 22 of the sleeve 9 against on the surface of the drum 7. Hence, a uniform gap S is always provided between the drum 7 and the sleeve 9. Therefore, even if the drum 7 is not located at a desired position, due to the fact that the parts of the photosensitive unit 4 has not been machined as precisely as desired, or due to the fact that the unit 4 has not bee precisely assembled into the housing, the frame 8 is displaced toward or away from the drum 7, for the distance corresponding to the positioning error of the drum 7. In other words, the positioning error is eliminated, and both annular protrusions 22 are pressed with the same force against the surface of the drum 7, whereby a gap S is formed between the drum 7 and the sleeve 9, which is uniform over the entire length of the drum 7. Even if the drum 7 is positioned not parallel to the sleeve 9, both side walls of the frame 8 move independently of each other, whereby the displacement between the drum 7 and the sleeve 9 is eliminated, and the protrusions 22 are pressed against the drum 7, thus forming a uniform ga S between the drum 7 and the sleeve 9. Hence, no skilled worker is required to assembly the units 4 and 5 into the housing 1 in the factory, or to achieve maintenance work, in order to provide a uniform gap between the photosensitive drum 7 and the developing sleeve 9.

To replace the photosensitive drum 7 with a new one, the developing unit 5 is moved away from the photosensitive unit 4, against the bias of the leaf springs 25 until the pins 24 drop into the portion 23*a* of the holes 23. As a result, the frame 8 is stopped. Then, the drum 7 is removed from the frame 6 and ultimately from the housing 1. Thereafter, a new drum 7 is set in place in the frame 6. The developing unit 5 is then moved toward the unit 4 because of the bias of the spring 25 until the annular protrusions 22 of the sleeve 9 contact the photosensitive drum 7. As a result, a gap S uniform along the entire drum 7 is automatically formed between the drum 7 and the sleeve 9 even if the new drum 7 has been set at a position slightly different from the correct position.

The image forming apparatus described above is operated in the following way to form an image on a sheet of recording paper.

First, the photosensitive drum 7 is rotated in the direction of the arrow (FIG. 1). Then, the charging unit (not shown) electrically charges the photosensitive surface of the drum 7. Next, the exposure unit 10 applies optical signals onto the photosensitive surface of the drum 7, thereby forming an electrostatic latent image thereon. The developing sleeve 9 is then rotated, thus supplying the toner from the toner cartridge (not shown) onto the photosensitive surface of the drum 7 through the gap S between the drum 7 and the sleeve 9. As a result, a latent image formed on the photosensitive surface of the drum 7 is developed into a toner image which is visible. Since the gap S is uniform all along the photosensitive drum 7, the toner is uniformly distributed on the entire surface of the photosensitive drum 7. As a result of this, the toner image has a sufficiently high quality. The toner image, thus formed on the drum 7, moves toward the image transfer unit 11 as the photosensitive drum 7 rotates in the direction of the arrow.

In the meantime, a sheet of recording paper has been fed from the paper cassette 13 toward the image transfer unit 11 by means of the rollers 14, 15, 16, and 17. The resist rollers 17 eliminates the skew, if any, of the sheet of recording paper, and then feed the sheet farther to the image transfer unit 11. The image transfer unit 11 transfers the toner image from the photosensitive drum 7 to the sheet of recording paper. The sheet is fed to the image-fixing rollers 12, whereby the toner image is fixed. Then, the sheet is supplied onto the tray 18 by means of the rollers 12.

The photosensitive surface of the drum 7 is electrically discharged as it passes by the discharging unit (not shown), and the cleaning unit (not shown, either) removes the residual toner from the drum 7 as the drum 7 is further rotated in the direction of the arrow.

According to the present invention, the means for moving the developing unit 5 toward or away from the photosensitive unit 4 is not limited to that one described above. Modifications to the image forming apparatus will now be described, with reference to FIGS. 4 to 9, in which the same components as those shown in FIGS. 2 and 3 are designated at the same reference numerals.

Figure 4:
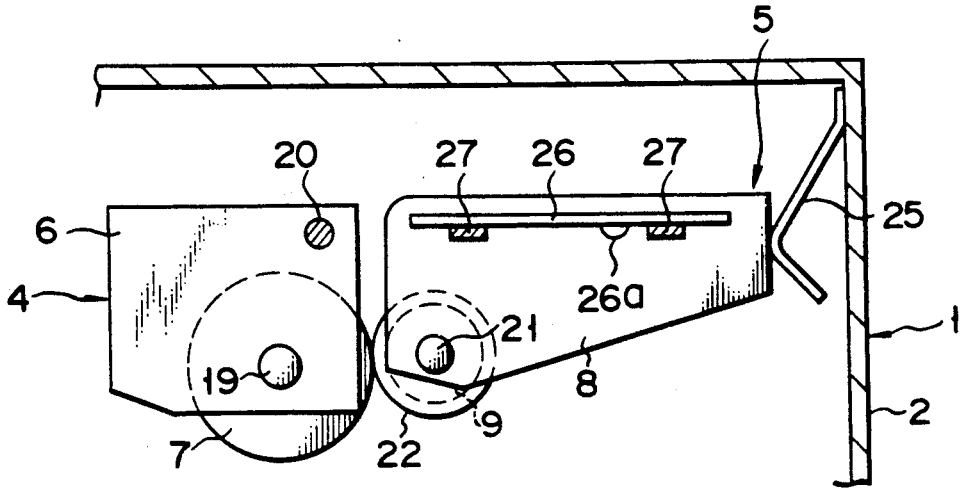
FIGS. 4 and 5 are a front view and a plan view, respectively, both partially cutaway and illustrating the support means supporting the photosensitive unit and the developing unit which are used in another type of image forming apparatus according to th epresent invention.
Figure 5:
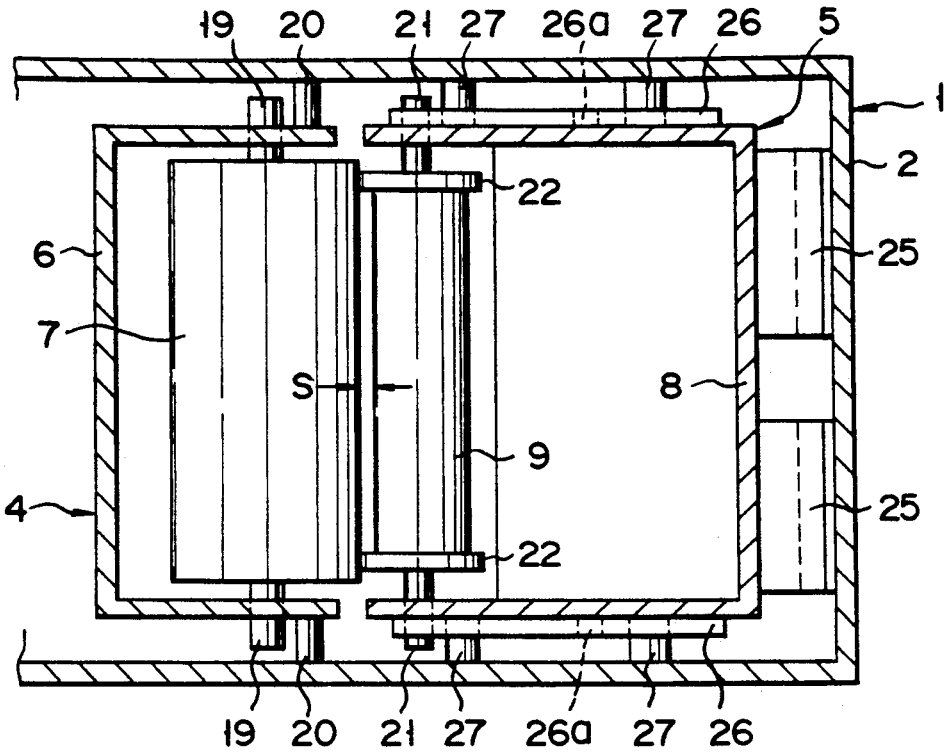

A first modification, shown in FIGS. 4 and 5, is characterized on two points. First, the developing unit 5 has one rail 26 mounted on the outer surface of either side of the frame 8. Second, two projections 27 protrude from the outer surface of either side of the housing 1 and contact the rail 26. Hence, the developing unit 5 can be moved horizontally toward and away from the photosensitive unit 4 as the projections 27 slides on the rails 26. The rails 26 each have a stopper 26*a* The developing unit 5 can be moved away from the photosensitive unit 4 until the stopper 26*a* abuts on the projections 27.

Figure 6:
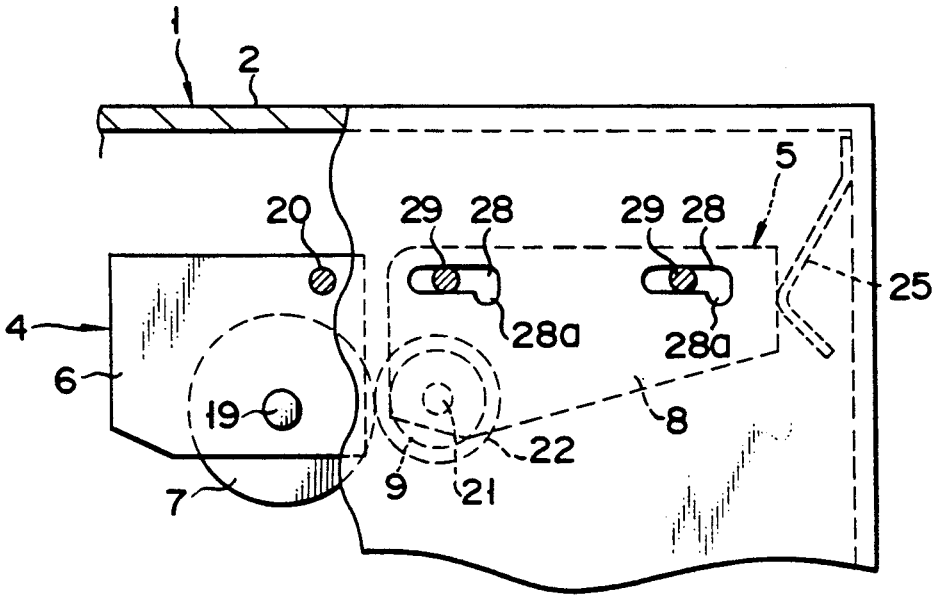
FIGS. 6 and 7 are a front view and a plan view, both partially cutaway and illustrating the support means supporting the photosensitive unit and the developing unit which are incorporated in a further type of image forming apparatus according to the present invention.
Figure 7:
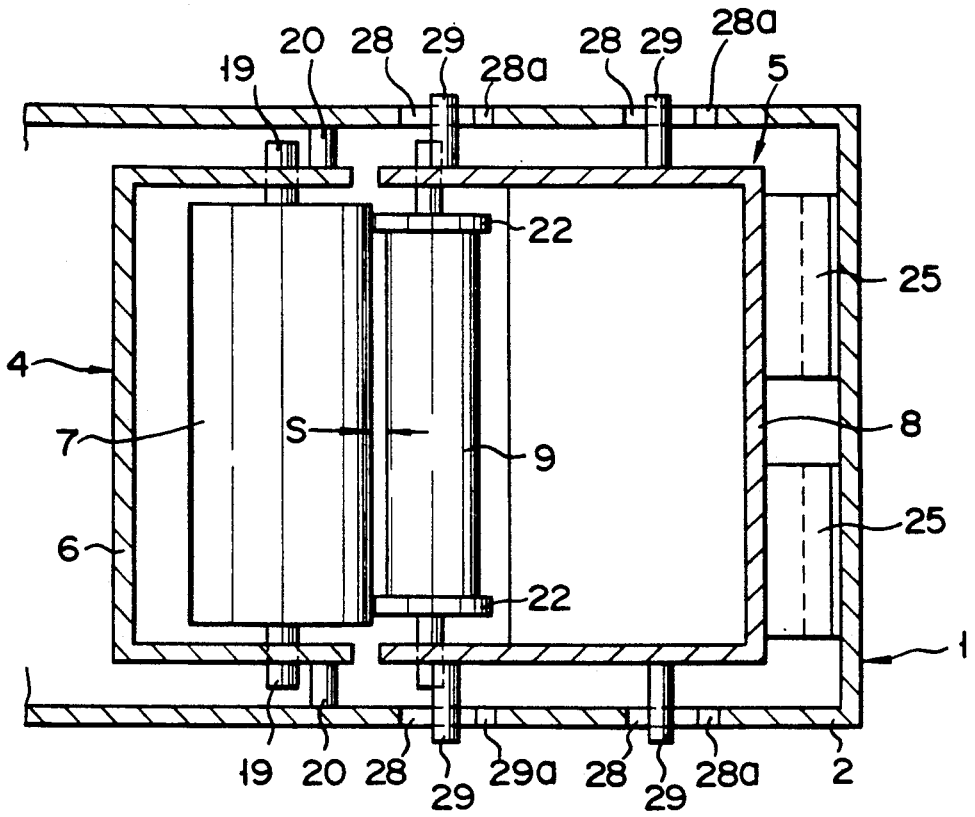

A second modification shown in FIGS. 6 and 7 is characterized on two points. First, two horizontally extending, elongated holes 28 are made in either side wall of the housing 1. Second, two pins 29 protrude from the outer surface of either side of the frame 8 of the developing unit 5, and are inserted in the elongated holes 28 of the side walls of the housing 1. Each elongated hole 28 has a downwardly extending portion 28*a*. Thus, the developing unit 5 can be moved toward and away from the photosensitive unit 4 as the projections 29 move back and forth in the elongated holes 28. The developing unit 5 can be moved away from the photosensitive unit 4 until the pins 29 slip into the downwardly extending portions 28*a* of the holes 28.

Figure 8:
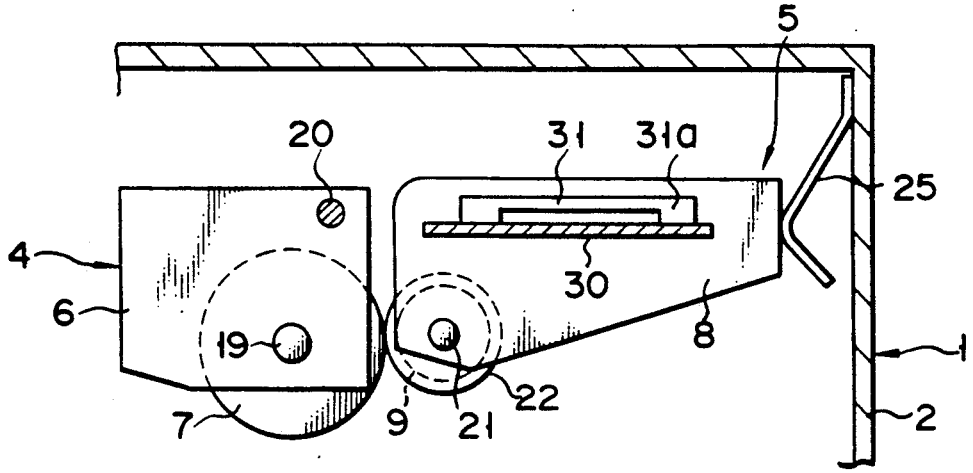
FIGS. 8 and 9 are a front view and a plan view, respectively, both partially cutaway and illustrating the support means supporting the photosensitive unit and the developing unit which are incorporated in a still another type of image forming apparatus according to the invention.
Figure 9:
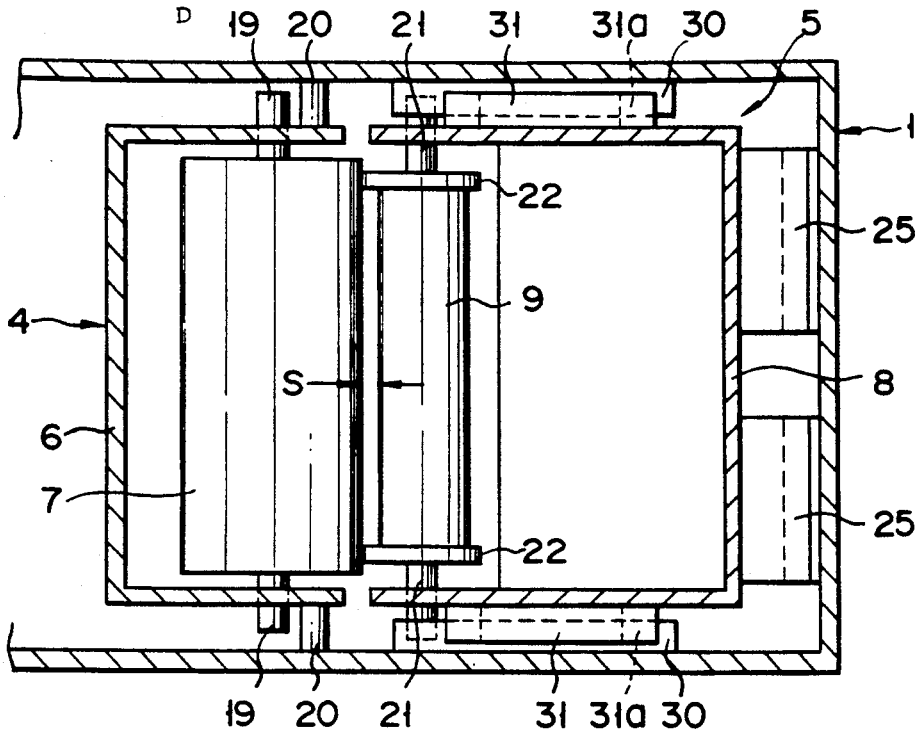

A third modification, shown in FIGS. 8 and 9, is characterized on two points. First, one horizontally extending rails 30 is laid on either side wall of the housing 1. Second, one support member 31 is formed on the outer surface of either side of the frame 8 of the developing unit 5 and is slidably mounted on the rail 30. The developing unit 5 can move toward and away from the photosensitive unit 4. Each support member 31 has a stopper 31*a*, and the developing unit 5 can be moved away from the photosensitive unit 4 until the stopper 31*a* is hooked onto the rear end of the rail 30.

The means for biasing the developing unit 5 toward the photosensitive unit 4 is not limited to the leaf springs 25 shown in FIGS. 2 and 3. Two modifications will be described with reference to FIGS. 10 and 11.

Figure 10:
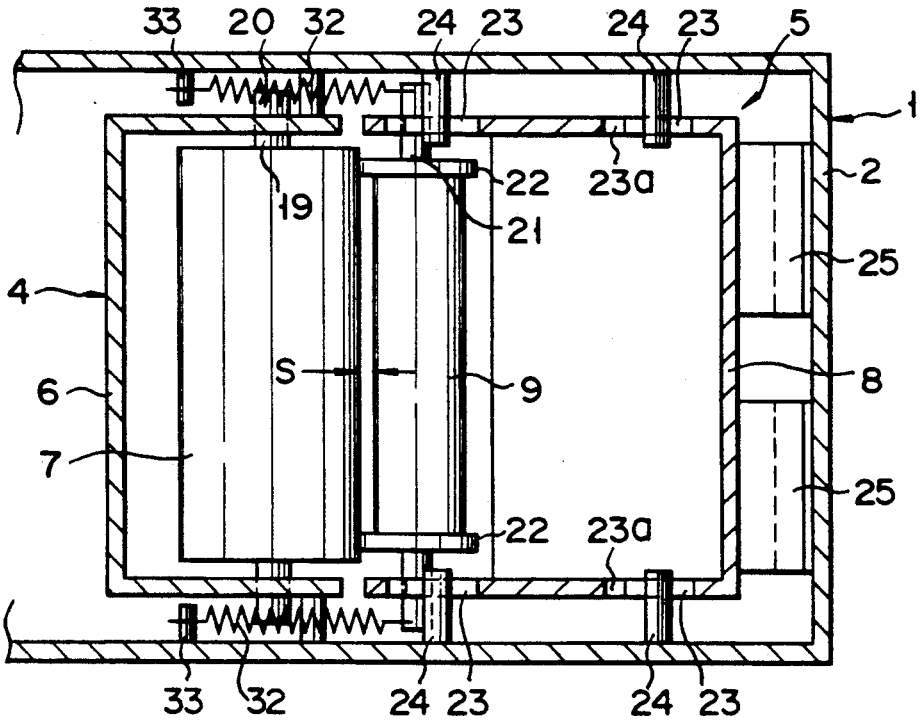
FIGS. 10 and 11 are a front view and a plan view, respectively, both partially cutaway and illustrating the support means supporting the photosensitive unit and the developing unit which are incorporated in yet another type of image forming apparatus according to the invention.

The modification shown in FIG. 10 has two coil springs 32, each located on the outer surface of either side wall of frame 8. Either coil spring 32 has one end fastened to the frame 8 and the other end connected to a pin 33 protruding from the inner surface of a side wall of the housing 1, thus biasing the unit 5 toward the unit 4.

Figure 11:
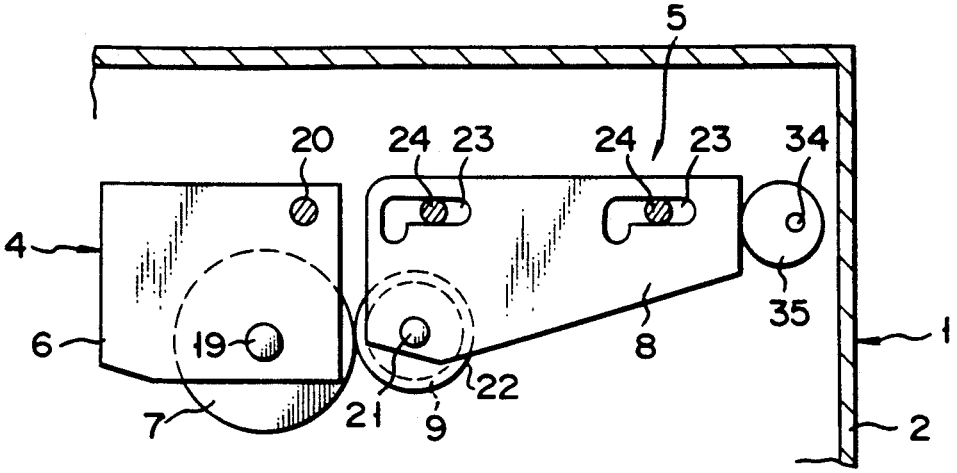

The modification shown in FIG. 11 has a cam shaft 34 extending between the side walls of the housing and a cam 35 mounted eccentrically on the cam shaft 34. The cam 35 is set in contact with the rear end of the frame 8. When the cam 35 is rotated, the developing unit 5 is moved toward and away from the photosensitive unit 4.

The positioning means for defining the gap S between the photosensitive drum 7 and the developing sleeve 9 is not limited to the one illustrated in FIGS. 2 and 3. Various modifications can be used in the present inventions. For instance, the annular protrusions 22 can be formed on the periphery of the drum 7, not on that of the developing sleeve 9. Other modifications will be described with reference to FIGS. 12 to 16.

Figure 12:
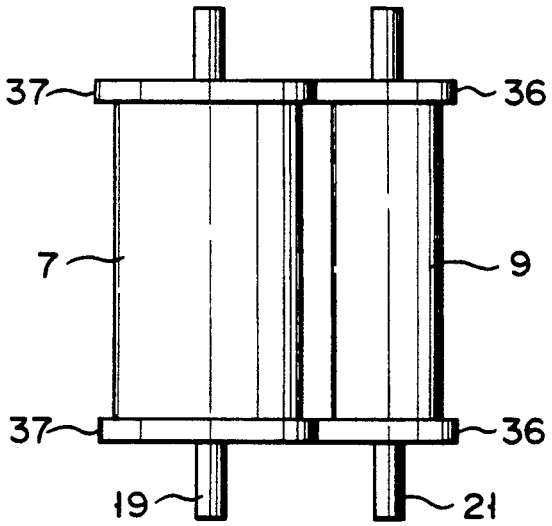
FIGS. 12 and 13 are the plan view, respectively, and front view of the positioning means according to the present invention.
Figure 13:
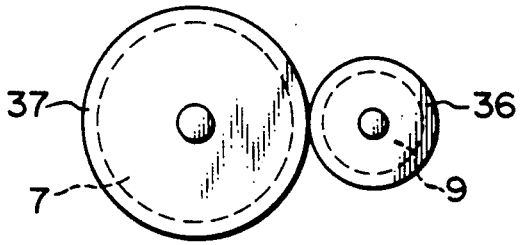

The modification illustrated in FIGS. 12 and 13 is characterized in that two annular protrusions 36 are formed on the ends of a developing sleeve 9, respectively, and two annular protrusions 37 are also formed on the ends of a photosensitive drum 6, respectively. The drum 7 and the sleeve 9 are located such that the protrusions 36 abut on the protrusions 37, thus defining a gap S between the drum 7 and the sleeve 9. The protrusions 37 are in rotating contact with the protrusions 36 while the drum 7 is rotating.

Figure 14:
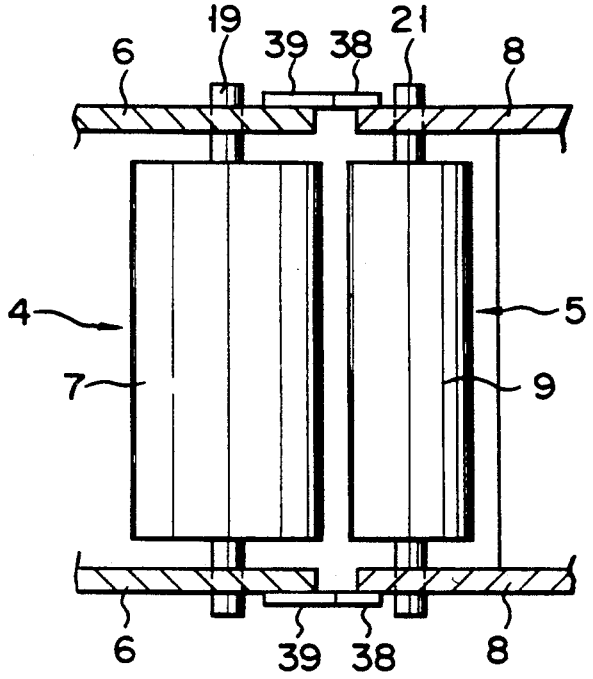
FIG. 14 is a plan view illustrating another type of positioning means according to the present invention.

The modification shown in FIG. 14 is characterized in that a positioning member 38 is attached to one end of either side wall of the frame 8, and a positioning member 39 is attached to one end of either side wall of the frame 6. The units 4 and 5 are positioned such that these members 38 and 39, which are not attached to the drum 7 or the sleeve 9, abut on each other, thereby defining a gap S between the photosensitive drum 7 and the developing sleeve 9.

Figure 15:
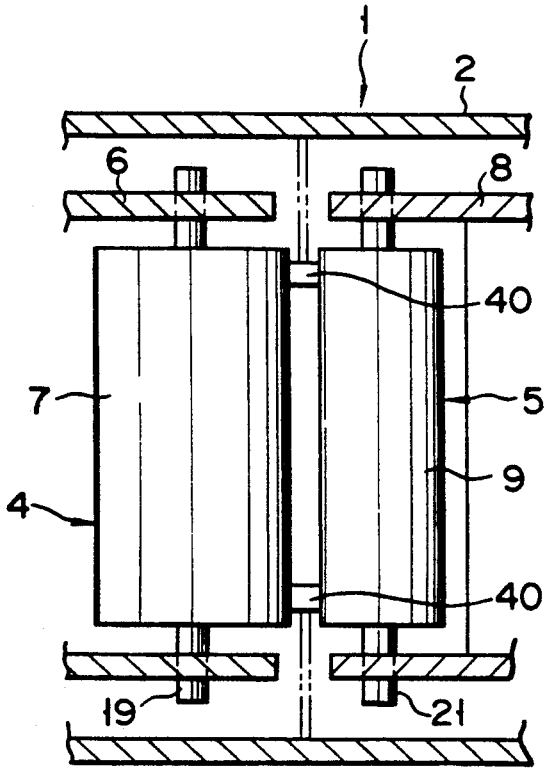
FIGS. 15 and 16 are the plan view and front view of still another positioning means according to the present invention.
Figure 16:
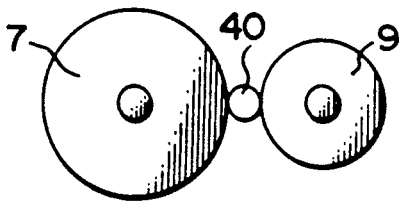

The modification shown in FIGS. 15 and 16 comprises members interposed between the photosensitive drum 7 and the developing sleeve 9. More specifically, two bearings 40 are coupled to the housing 1 by suitable means, and are interposed between the drum 7 and the sleeve 9. They are set in rolling contact with both the drum 7 and the sleeve 9, thereby defining a gap S between the photosensitive drum 7 and the developing sleeve 9.

According to the invention, the means for supporting the units 4 and 5, the means for biasing the unit 5, and the means for positioning the units 4 and 5 —all described above—can be used in various combinations.

Figure 17:
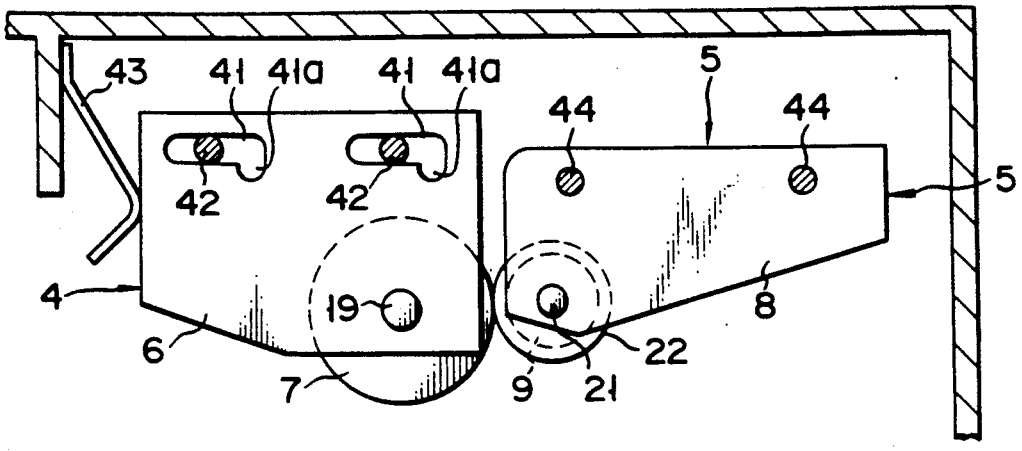
FIG. 17 illustrates a combination of a photosensitive unit and a developing unit, according to the present invention.
Figure 18:
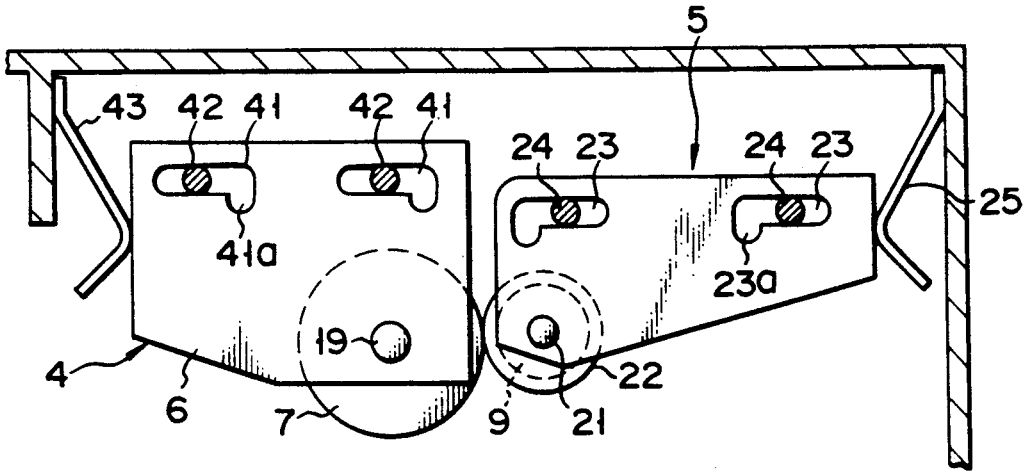
FIG. 18 illustrates another combination of a photosensitive unit and a developing unit, according to the present invention.

In any embodiment described above, the photosensitive unit 4 is fixed, whereas the developing unit 5 is movable. The present invention is not limited to these embodiments. For example, the unit 4 can be movable, and the unit 5 is fixed, as is illustrated in FIG. 17. Alternatively, both units 4 and 5 can be movable as is illustrated in FIG. 18. In FIGS. 17 and 18, the same components as those shown in FIGS. 2 and 3 are designated by the same reference numerals. The embodiments shown in FIGS. 17 and 18 will be described in greater detail.

In the embodiment shown in FIG. 17, two elongated holes 41 is made in either side wall of the frame 6. The holes 41 extend horizontally, each having a portion 41*a* extending downwardly. Two pins 42 protrude from the inner surface of either side wall of the housing 1, and are inserted in the elongated holes 41, respectively. Leaf springs 43, fastened to the inner surface of the housing, apply bias to the frame 6. The photosensitive unit 4 is therefore biased toward the developing unit 5. The developing unit 5 is fixed at a predetermined position by means of support shafts 44 extending between the side walls of the housing 1. The frame 6 is moved toward the unit 5 until the drum 7 abuts on the annular protrusions 22 of the developing sleeve 9, thus defining a gap S between the drum 7 and the sleeve 9.

In the embodiment shown in FIG. 18, the photosensitive unit 4 is biased toward the developing unit 5 as in the embodiment shown in FIG. 2, and the developing unit 5 is biased toward the photosensitive unit 4 as in the embodiment shown in FIG. 17. More specifically, leaf springs 25 bias the frame 8 of the unit 6 toward the drum 7, whereas leaf springs 43 bias the frame 6 of the unit 4 toward the sleeve 9. As a result, the annular protrusions 22 of the sleeve 9 abut on the drum 7, whereby a uniform gap S is formed between the drum 7 and the sleeve 9.

In the embodiments shown in FIGS. 17 and 18, the means for supporting the units 4 and 5, the means for biasing the unit 5, and the means for positioning the units 4 and 5—all described above—can be used in various combinations. Any combination of the means can be applied to the photosensitive unit 4, just in the same way as to the developing unit 5.

Furthermore, the positioning means according to the present invention can be applied not only to the photosensitive unit 4 and the developing unit 5, but also to any other units of the image forming apparatus, which are arranged around the photosensitive unit 4.

What is claimed is:

1. An image forming apparatus comprising:

a photosensitive member and a first frame having first portions supporting the photosensitive member therebetween, each of said first portions extending in a predetermined direction perpendicular to a longitudinal axis of said photosensitive member;

a developer unit including a cylindrical developer sleeve juxtaposed to said photosensitive unit and a second frame having second portions supporting the developer sleeve therebetween, each of the second portions extending in said predetermined directions so that each of said first portions oppose corresponding ones of said second portions in a colinear manner, said photosensitive member and said developer sleeve being independently supported by the first and second frames, respectively, such that the first and second frames are separate and independent of one another;

support means for supporting at least one of the first and second frames of said photosensitive direction and in a direction opposite thereto to provide at least one movable frame;

biasing means for applying a force to the at least one movable frame directed in said predetermined direction to move said first and second frames toward one another; and positioning means, including first positioning members mounted one on each of the first portions of the first frame of said photosensitive unit along said predetermined direction, and second positioning members mounted one on each of the second portions of the second frame of said developer unit along said predetermined direction, said first positioning members and said second positioning members abutting one another so as to define a gap between the photosensitive member and the developer sleeve.

2. The image forming apparatus according to claim 1, wherein the at least one moveable frame has holes formed therein and elongated in the predetermined direction in which said at least one movable frame moves toward and away from the other frame, and said support means includes support members provided separately from said at least one movable frame and inserted in the elongated holes so as to support said at least one movable frame for movement.

3. The image forming apparatus according to claim 1, wherein said support means includes a member which is provided separately from said at least one movable frame and in which holes are formed such that the holes are elongated in the predetermined direction in which said at least one movable frame moves towards and away from the other frame, and support members attached to the at least one movable frame and inserted in the elongated holes so as to support said at least one movable frame for movement.

4. An imaging apparatus comprising:

a photosensitive unit including a first frame and a cylinderical photosensitive member having two end portions;

a developer unit including a second frame and a cylindrical developer sleeve which opposes said photosensitive unit and has two end portions;

support means for supporting at least one of the first and second frames of said photosensitive and developer units so as to be movable in a predetermined direction and in a direction opposite thereto to provide at least one movable frame;

biasing means for applying a force to at least one of the first and second frames in said predetermined direction to move one of the first and second frames toward the other;

positioning means including a pair of rotating members having circular cross-sections, one of said rotating members being arranged between one of the end portions of the photosensitive member and one of the end portions of the developer sleeve, said one end portion of the photosensitive member and said one end portion of the developer sleeve opposing each other, the other of said rotating members being arranged between the other of the end portions of the photosensitive member and the other of the end portions of the developer sleeve, said other end portion of the photosensitive member and said other end portion of the developer sleeve opposing each other, said rotating members defining a gap between the photosensitive member and the developer sleeve; and means for supporting the pair of rotating members independently of said developer sleeve.

5. The image forming apparatus according to claim 4, wherein the at least one movable frame has holes formed therein such that the holes are elongated in the predetermined direction in which said at least one movable frame moves toward and away from the other frame, and said support means includes support means provided separately from said at least one movable frame and inserted in the elongated holes so as to support said at least one movable frame for movement.

6. The image forming apparatus according to c claim 4, wherein said support means includes a member which is provided separately from said at least one movable frame and in which elongated holes are formed such that the holes are elongated in the predetermined direction in which said at least one movable frame moves toward and away from the othe frame, and support members attached to the at least one movable frame and inserted into the elongated holes so as to support said at least one movable frame for movement.

7. The image forming apparatus according to claim 4, wherein each of the rotating members has a diameter equal to sleeve and wherein the rotating members have a common rotational axis extending between the photosensitive member and the developing sleeve.

8. A method for positioning a photosensitive unit and a developer unit for an image forming apparatus relative to one another, said method comprising the steps of:

providing a photosensitive unit including a cylindrical photosensitive member and a first frame having first portions supporting the photosensitive member therebetween, said first portions being arranged along a predetermined direction perpendicular to a longitudinal axis of the photosensitive member;

providing a developer unit including a cylindrical developer sleeve juxtaposed to said photosensitive unit and a second frame having second portions supporting the developer sleeve therebetween, each of the second portions being arranged along said predetermined direction so that each of said first portions oppose corresponding ones of said second portions in a colinear manner, said photosensitive member and said developer sleeve being independently supported by said first and second frames, respectively, such that the first and second frames are separate and independent of one another;

movably supporting at least one of the first and second frames of said photosensitive and developer units so as to be movable in said predetermined direction and in a direction opposite thereto;

applying a force to at least one of said first and second frames in said predetermined direction to move one of said first and second frames toward the other; and abutting first positioning members, mounted one on each of the first portions of the first frame of said photosensitive unit along said predetermined direction, against second positioning members, mounted one on each of the second portions of the second frame of said developer unit along said predetermined direction, to define a gap between the photosensitive member and the developer sleeve.

9. A method for positioning a photosensitive unit and a developer unit of an image forming apparatus relative to one another, said method comprising the steps of:

providing a photosensitive unit including a first frame and a cylindrical photosensitive member having two end portions;

providing a developer unit including a second frame and a cylindrical developer sleeve, which is juxtaposed to said photosensitive unit, and has two end portions;

movably supporting at least one of the first and second frames of said photosensitive and developer units so as to be movable in a predetermined direction and in a direction opposite thereto;

applying a force to at least one of said first and second frames in said predetermined direction to move one of said first and second frames toward the other; and arranging a pair of rotating members, one between one of the end portions of the photosensitive member and one of the end portions of the developer sleeve, said one end portion of the photosensitive member and said one end portion of the developer sleeve opposing each other, and the other rotating member between the other of the end portions of the photosensitive member and the other of the end portions of the developer sleeve, said other end portion of the photosensitive member and said other end portion of the developer sleeve opposing each other, the pair of rotating members being supported independently of said developer sleeve; and positioning the photosensitive member and the developer sleeve relative to each other so that each abut said pair of rotating members to define a gap between the photosensitive member and the developer sleeve.

10. A method according to claim 9, wherein each of the rotating members has a diameter equal to the gap between the photosensitive member and the developing sleeve, and wherein the rotating members have a common rotational axis extending between the photosensitive member and the developing sleeve.

* * * * *